United States Patent [19]

Carroll

[11] 4,094,524

[45] June 13, 1978

[54] SKATE BOARD BRAKING AND STEERING SYSTEM

[76] Inventor: Mathew Ralph Carroll, 3516 Downing, Glendale, Calif. 91208

[21] Appl. No.: 733,389

[22] Filed: Oct. 18, 1976

[51] Int. Cl.[2] ..... A63C 17/14

[52] U.S. Cl. ..... 280/11.2; 280/87.04 A; 188/29

[58] Field of Search ..... 280/87.04 A, 87.04 R, 280/11.2; 188/29

[56] References Cited

U.S. PATENT DOCUMENTS

| | | | |
|---|---|---|---|
| 1,371,623 | 3/1921 | Ickenroth | 280/11.2 |
| 1,637,129 | 7/1927 | Pritchett | 280/87.04 R |
| 3,288,251 | 11/1966 | Sakwa | 280/87.04 A X |
| 4,003,582 | 1/1977 | Maurer | 280/87.04 A X |

*Primary Examiner*—Joseph F. Peters, Jr.

*Assistant Examiner*—Gene A. Church

*Attorney, Agent, or Firm*—John E. Wagner

[57] ABSTRACT

A skate board including a body and a pair of trucks located fore and aft with a friction brake pivotally mounted with respect to the board body to bring a pair of brake shoes into engagement with each of two rear wheels of the rear truck. An operator arm extends from the truck upward above the level of the board whereby the foot of the rider may be used to pivot the brake shoes into engagement with one or the other or both of the truck wheels. The brake arm and shoe assembly is pivotal about a transverse horizontal axis to bring the shoes into engagement with the surface of the wheels and likewise is pivotal around a longitudinal axis to selectively engage one or the other of the two wheels for steering. The operator arm may be operated by either the rear foot of the rider or by his hand in certain cases when the rider is crouched upon the board.

14 Claims, 8 Drawing Figures

SKATE BOARD BRAKING AND STEERING SYSTEM

BACKGROUND OF THE INVENTION

A truly remarkable sport has evolved through the years in the form of the modern day skate board. It is an outgrowth of earlier skooters employing a single roller skate divided into fore and aft parts secured to a horizontal board with the vertical T shaped handle at the front. The evolution including the elimination of the handle and the use of more sophisticated truck has produced an athletic device which allows young children and adults to develop amazing skill in the ability not only to travel along a straight course at high rates of speed, as high as 60 miles per hour, and to perform maneuvers including hand stands, 360° turns, slalom course races and many other tricks.

The modern day skate board, with this tremendously enhanced maneuverability and speed potential has produced many battle scars for riders. Characteristics of skate board riders are skinned forearms and worn out shoes. One of the first obvious limitations is that the two truck four wheel device has no means in itself of stopping. The most common technique for stopping is for the rider to leave the board. When this is done at high speed, the rider's success depending upon his ability to land without injury. Also, courses are often constructed with runout regions with skip jumps to assist slowing the rider. One of the major requirements for trick riding of the skate board is the ability of the rider to balance precisely on the board and shift his weight forward and rearward, and to the left and to the right to provide the maneuverability required. For example, a 360° turn requires the rider to shift his weight almost entirely to the rear truck and in some cases drag the tail of the board to slow his speed, and then pivot his weight and the board to cause the rear to spin through a 360° turn. This is usually performed on the rear truck and most often without any forward motion.

Many of the maneuvers are possible by reason of the suspension system of the trucks which allows the board to be tipped about the fore and aft axis by the shifting of the rider's weight in the direction of the angle of twist.

Thus, despite the remarkable achievements with the simple skate board, there have been many, many injuries due to the inability of the rider to stop the board, and also the full capability of steering and sharp pivotal turns underway have been limited.

BRIEF STATEMENT OF THE INVENTION

With the foregoing state of the art in mind, it is a general object of the invention to improve the maneuverability and safety of the wheeled vehicles, particularly skate boards. It is another object of this invention to provide a brake for skate boards which does not interfere with the normal use or maneuvers of the rider.

Another object of the invention is to provide a skate board brake in which the rider can selectively brake either or both of the rear wheels to allow not only stopping but steering as well.

These objects are all achieved in accordance with this invention employing a brake assembly having a plate member which is secured to the under side of the board and mounts a U shaped arm carrying a pair of shoes which can be brought into engagement with the rear wheels of the skate board. The U shaped member is pivotally mounted with respect to the plate from a position ahead of the rear wheels and is controlled by operation of an operator arm about a transverse generally horizontal axis to bring the brake shoes into engagement with the rolling surface of the rear wheels. The pivotal engagement between the plate and the U shaped arm includes provision for rotation about a second axis which is inclined with respect to the longitudinal axis of the board. With this feature the U shaped arm and brake shoes may be laterally pivoted to bring one or the other of the brake shoes into engagement with its respective wheel while leaving the other wheel free to turn.

The brake assembly is actuated by an arm which extends to one side of the board and above its level whereby it may be operated by the heel of the rider or by his hand if he so desires. A return spring of generally leaf shape is secured to the plate member and engages both arms of the U shaped member whereby the U shaped member is moved out of engagement with the wheels in the absence of pressure on the lever arm.

BRIEF DESCRIPTION OF THE DRAWINGS

This invention may be more clearly understood from the following detailed description and by reference to the drawings in which.

DETAILED DESCRIPTION OF THE INVENTION

Figure 1:
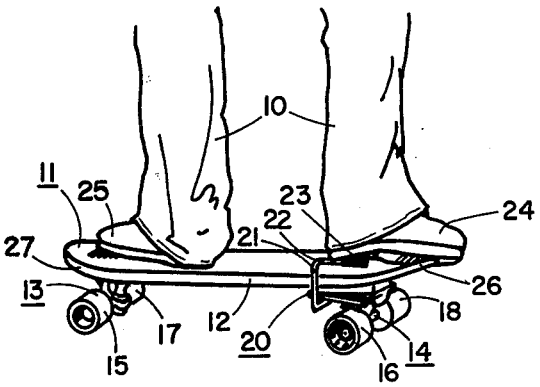
FIG. 1 is a fragmentary perspective view of a rider and a skate board employing the brake of this invention.

Now referring to FIG. 1, a typical modern skate board but one incorporating this invention may be seen in use with the rider 10 riding a skate board generally designated 11, including board or body 12, a front truck assembly 13 and a rear truck assembly 14, each including respectively a pair of front wheels 15 and 17 and a pair of rear wheels 16 and 18. The wheels 15 and 16 are on the left hand side of the board and the wheels 17 and 18 are on the right hand side. Mounted generally beneath the board 12 and above the rear truck 14 is the steering brake assembly 20 of this invention. As shown in FIG. 1, the brake assembly 20 includes an operator arm 22 which includes a generally vertical portion 21 located in FIG. 1 below the heel 23 of the right foot 24 of the rider 10. The left foot 25 is shown flat on the board generally in the region of the front truck 13. The ball of the foot 24 overrides the rear right edge of the board 12, thus the ball of the right foot 24 is in contact with the board and the heel of the foot 24 with the brake 20. It should be noticed in FIG. 1 that the rider is standing generally erect and as shown, is riding in a generally straight line and applying the brake for stopping the skate board. It should also be noticed that the skate board as shown in FIG. 1 is of a popular design being somewhat teardrop in shape with the noticable upturned prow 27 and tail 26. The tail 26 has been in the past commonly used as somewhat of a brake by shifting the weight of the rider totally to the right foot 24 and guardedly elevating the prow 27 off the ground until the tail 26 drags. This method of braking is hazardous in its own right and an alternate method of braking has been developed in which the rider drags the toe of his rear, or in this case right foot 24 with the dragging tending to stop the board and to wear out the rider's shoes. Skate board riders are often identifiable by their skinned forearms and worn out shoes.

Figure 2:
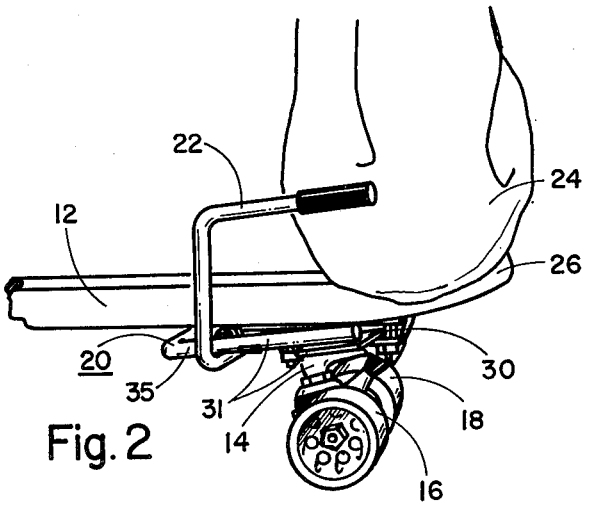
FIG. 2 is an enlarged fragmentary view of the skate board and rider of FIG. 1 with the brake disengaged.

Somewhat greater detail of the brake assembly 20 may be seen in FIG. 2 in which the rider has shifted his right foot 24 from the brake and is riding on the rear tail 26 with that foot. The lever arm 22 of the brake assembly as now is apparent, is elevated significantly above the level of the top of the board 12. Also, in FIG. 2 the truck 14 and its two wheels 16 and 18 are more clearly visible, and particularly the brake assembly may be seen as including a pair of shoes 30 and 31, the latter of which only appears in FIGS. 3, and 5–8. The shoe 30 is mounted as by welding on a U shaped arm 35 to which the lever arm 22 is secured as by welding. As shown in FIG. 2, the brake shoe 30 is located above the surface of the wheel 16 and out of engagement therewith. In this case, as indicated above, the brake 20 and its lever arm 22 are out of the normal movement of both the trucks and the foot of the rider whereby the board may be ridden in a totally normal uninhibited manner.

Figure 3:
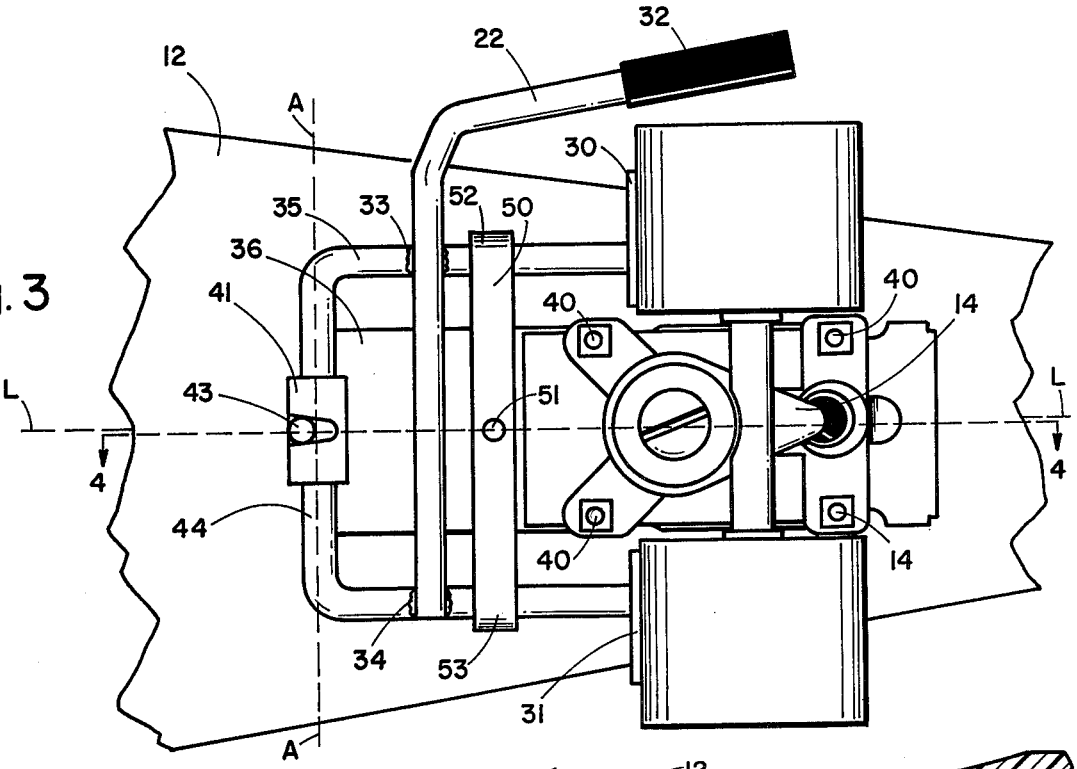
FIG. 3 is a fragmentary underside view of the rear truck and brake assembly of a skate board of FIG. 1.

Now referring to FIG. 3 where a more detailed view of the skate board abrake of this invention may be seen, the operator arm 22 including its end protective sleeve 32 is secured as by welding at two points, namely 33 and 34 to the U shaped arm member 35 which carries the two brake shoes 30 and 31. The U shaped member 35 is pivotally mounted about a transverse generally horizontal axis A from a plate 36 which is secured to the underside of the board 12. In the case as shown, the plate 36 includes mounting holes which match the screw fasteners 40 of the truck 14 and is merely secured between the truck and the board 12 by the same fasteners which secure the truck 14 to the board 12. The U shaped member 35 is rotationally secured to the plate 36 by the integral roll sleeve 41 constituting the end of the plate 36. As may be seen, however, in FIG. 4, the sleeve 41 and the U shaped member 35 have a major degree of clearance C, and a fastener such as a rivet 43 extends through the sleeve portion 41 and the central bottom portion 44 of the U shaped member 35. This rivet 43 forms a second axis B which intersects fore and aft along the longitudinal axis L as shown in FIG. 3 of the entire skate board assembly but is inclined with respect to that axis L at an angle alpha. The angle alpha has been found to fall in the range of 20° to 90° without interference with the normal and intended operation of the brake of this invention for steering purposes.

Figure 4:
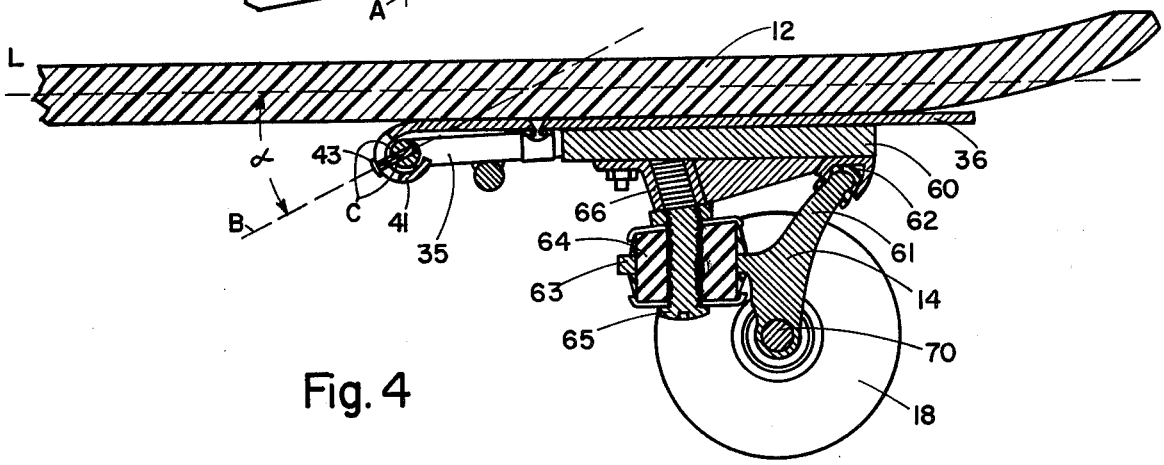
FIG. 4 is a vertical sectional view along line 4—4 of FIG. 3.

In FIGS. 3 and 4, a return spring in the form of a transverse leaf spring secured at its center point as by rivet 51 to the plate 36 serves to return the arm 35 and the two brake shoes 30 and 31 to the disengaged position whenever the arm 22 is not operated. An alternate form of return spring is a pair of tension springs secured between the plate 36 and the U shaped member 35, however, tension springs are not preferred because of the slight clearances involved and inadequate travel. A leaf spring 50 is preferred and may also include end bends such as 52 and 53 which act as limits to the transverse movements of the arm 35.

FIGS. 3 and 4 show additionally the details of the truck 14 as including a base 60, a rear inclined arm 61 which is resiliently secured in a recess 62. The truck 14 includes a horizontal apertured arm 63 which engages a captured resilient mount 64 secured as by screw 65 to a forward column 66. The resilient mount 64 provides a degree of springing and shock absorbing for the wheel 18 which is mounted by axle 70 but also allows the board 12 to be pivoted through a slight angle about the longitudinal axis L for normal steering and acrobatics.

The brake of this invention cooperates with the suspension system in not only the braking but in steering as it may be visible in FIGS. 5–8.

Figure 5:
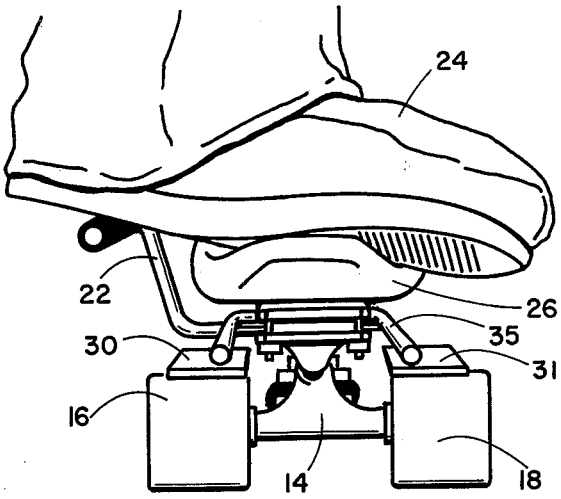
FIG. 5 is a rear view of a skate board rider operating the brake in normal braking condition.

Now referring to FIG. 5, the rear view of the rider in the situation similar to that of FIG. 1 may be seen. In this case, the rider and skate board are going away from the viewer with the rider's foot 24 located with his heel on the brake arm 22 and the ball of his foot on the rear tail 26 of the board. The rider and board are for all intensive purposes vertical. The arm 22 is depressed as is the U shaped member 35, and the two brake shoes 30 and 31 engage the surface of their respective wheels 16 and 18. Under these circumstances, the board, while going ahead, comes to a smooth halt either to terminate a straight run or to allow the rider to perform static acrobatics. As shown, the lever arm 22 is applying relatively even force to both brake shoes 30 and 31 whereby a smooth straight stop is achieved. Stopping in this manner obviates the need to employ the tail 26 or the rider's foot for stopping.

Figure 6:
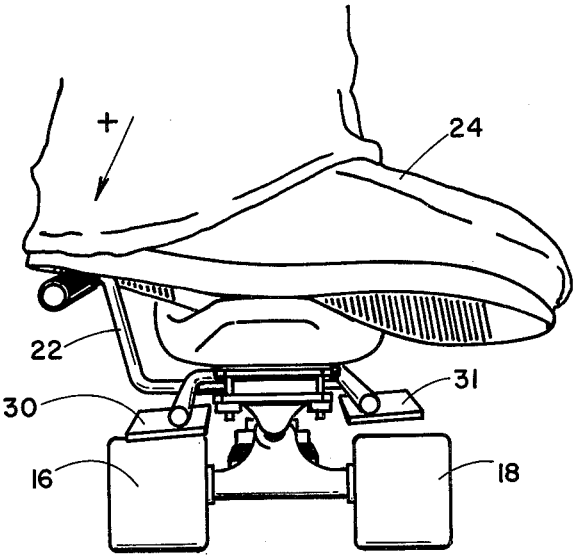
FIG. 6 is a rear view of the rider employing the brake assembly of this invention for steering with the brake engaging the left rear wheel only.

Now referring to FIG. 6, the same board and the same rider is involved in beginning a maneuver such as a slalom turn or a rearward 180° or 160° turn. In this case the rider's foot is interceptably positioned differently with respect to FIG. 5 but the force of the foot 24 is applied not only vertically but generally in the direction of the arrow X shown in FIG. 6. In this case the arm 22 is again pivoted downward but likewise is pivoted around the axis B shown in FIG. 4 and the shoe 30 engages wheel 16 while the shoe 31 remains free of wheel 18. Under these circumstances, wheel 16 is either totally or partially locked and the rider may make a sharp near 180° turn while moving or while stopped, or may make a 180° or 360° turn more easily and with greater control than heretofore.

Figure 7:
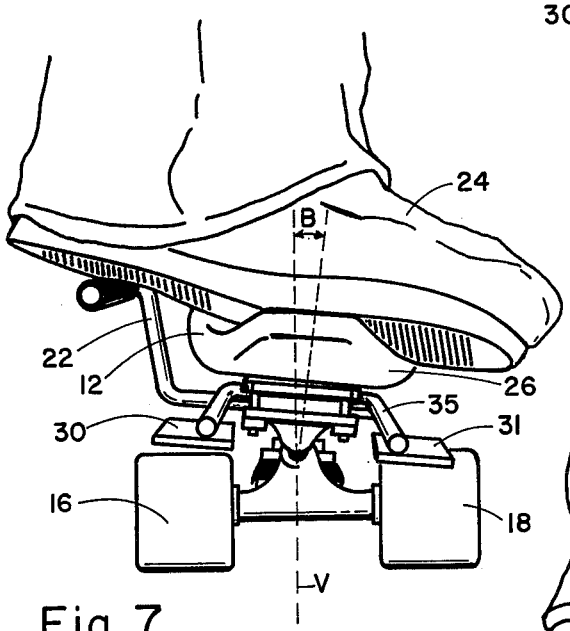
FIG. 7 is a rear view of the skate board employing this invention with the rider engaging the brake against the rear right wheel only.

Even with the rider in the same stance as shown in FIGS. 5 and 6, he may accomplish braking on the opposite wheel 18 while leaving wheel 16 free to turn as shown in FIG. 7. In this case, again the foot 24 is moved almost imperceptably to the left hand side of the board with the front part of the heel engaging the arm 22 and the ball of the foot engaging the board 12 at the rear tail 26. In this case, the force of the rider's weight is applied in such a manner as to deflect the arm 22 and at the same time deflect the board 12 about its vertical axis to an inclined angle beta. Owing to the fact that the U shaped member 35 is pivoted about the axis B of FIG. 4, the shoe 31 engages the wheel 18 on a straight stopping routine as shown in FIG. 5. There is significantly greater than line contact which would be achieved if only the deflection of board 12 was employed for selective braking.

Figure 8:
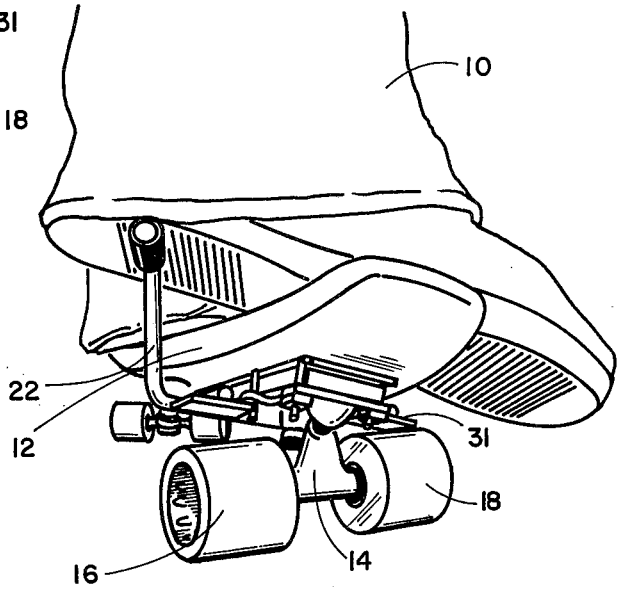
FIG. 8 is a rear quarter perspective view of the maneuver of FIG. 7 showing the brake applied to the rear right wheel only.

The maneuver of FIG. 7 may be more clearly seen in FIG. 8 where a hard over turn to the right is being carried out by the rider 10. In this case, the shifting of weight of the rider 10 to the right side of the board has caused the front truck to twist slightly to afford a degree of steering and that combined with the application of the brake force via the arm 22 and the shoe 31, allows a sharp or slalom turn to be achieved. Note in FIG. 8 that the arch of the foot is located directly over the board 12 and the board is significantly angled to the right in making this maneuver.

From the foregoing description it may be seen that an improved steering brake has been devised employing a relatively simple structure but one which provides two degrees of motion in order to apply not only braking to the rear wheels of the skate board but steering by selective and controllable application of braking force to either of the wheels independently. The brake assembly is so designed that it is secured to the skate board with no additional fasteners other than required to mount the rear truck, and the actuating arm is located to the side and rear of the board where it does not interfere with any normal maneuvers or tricks. As so located, the operator arm may be actuated by either the heel or the toe of the rider, and if desired, his hand, to give precise control of the braking force applied. The U shaped braking arm being pivoted about two axes allows not only the rapid and effective application of even braking force but the selective braking of either of the rear wheels.

The above described embodiments of this invention are merely descriptive of its principles and are not to be considered limiting. The scope of this invention instead shall be determined from the scope of the following claims including their equivalents.

What is claimed is:

1. A skate board assembly comprising:

a board having a longitudinal generally horizontal axis;

a front truck secured to said board;

a rear truck secured to said board having a pair of wheels;

a brake assembly secured to said skate board assembly including a pair of brake shoes;

actuator means for pivoting said brake shoes about a first axis substantially transverse to said longitudinal axis of said board and selective into engagement with said wheels by the application of force to said actuator means;

means mounting said actuator means for rotational movement about a second axis at an inclined angle with respect to the said longitudinal axis of the board whereby said actuator means may pivot said brake shoes into simultaneous engagement with both wheels of said rear truck by pivoting about said transverse axis or into engagement with one of said wheels by rotation of said actuator means about said second axis of rotation.

2. The combination in accordance with claim 1 wherein said actuator means includes a U shaped member pivotally secured to the underside of said board and with said brake shoes located at the end of each of the arms of said U shaped member.

3. The combination in accordance with claim 2 wherein said brake assembly includes a base secured to said skate board body and includes tubular bearing portion for engaging the central part of the U of said U shaped member to allow the pivotal movement of said U shaped member about said transverse axis to bring said brake shoes into engagement with the surface of the wheels of said rear truck.

4. The combination in accordance with claim 3 including pivot means for securing said U shaped member to said plate in the region of said tubular portion whereby said U shaped member may be rotated about said second axis inclined with respect to the horizontal whereby said U shaped member may be pivoted to bring one or the other of said brake shoes into engagement with respect to its respective wheel.

5. The combination in accordance with claim 1 including an actuator arm extending to the side and above the board whereby said brake assembly may be actuated by movement of part of the rider's anatomy to depress the arm without interference with the upper surface of said skate board.

6. The combination in accordance with claim 2 including return spring means secured to said brake assembly and said U shaped member to return said U shaped member and brake shoes to a non-engaging position in the absence of brake applying force.

7. The combination in accordance with claim 8 wherein said plate mounts spring means for returning said U shaped member to a non-actuated position in the absence of an actuating force.

8. The combination in accordance with claim 1 including a plate member securable between the underside of the skate board body and the rear truck and wherein said plate member mounts a U shaped member in a generally horizontal position with said brake shoes normally located above the wheels of said truck.

9. The combination in accordance with claim 5 wherein said actuator arm includes a vertical portion extending above the level of the board and a horizontal portion extending generally rearward and beside said board against which the rider may apply brake actuating force.

10. The combination in accordance with claim 9 wherein said spring member constitutes a laterally extending leaf spring engaging both arms of said U shaped member and including end restraints for limiting lateral movement of said U shaped member.

11. A brake assembly for skate boards and the like having a board and a pair of wheeled trucks comprising:

a plate including mounting means for securing said assembly to a skate board in the region of one of the trucks thereof;

a generally U shaped member;

said U shaped member carrying a pair of brake shoes, one on each respective end region of the arms of said U shaped member;

said U shaped member being pivotally secured to said plate to bring said brake shoes into engagement with the wheels of the said truck of said skate board; and means extending to the side of said skate board actuatable by the rider of a skate board to pivot said U shaped member and said brake shoes into engagement with the wheels of said skate board truck.

12. The combination in accordance with claim 11 wherein said actuator means comprises an arm engaging said U shaped member and extending above said plate for actuation by the foot of a rider.

13. The combination in accordance with claim 11 wherein said U shaped member is pivotally mounted with respect to said plate for movement about two axes, one of said axes being substantially horizontal and normal to the length of said skate board and the second axis being substantially vertical, whereby said brake shoes may be selectively brought into braking engagement with either one or both wheels of a truck of a skate board.

14. The combination in accordance with claim 13 wherein said plate includes an integral sleeve surrounding the central portion of said U shaped member to define the first of said two axes, and said U shaped member is further engaged to said plate by shaft means allowing rotation about the second of said two axes.

* * * * *